US011377260B2

(12) United States Patent
Pittman et al.

(10) Patent No.: US 11,377,260 B2
(45) Date of Patent: Jul. 5, 2022

(54) ELECTRONICS ENCLOSURE

(71) Applicant: CONNECTED SOLUTIONS GROUP, LLC, Mechanicsville, VA (US)

(72) Inventors: Michael C. Pittman, Mechanicsville, VA (US); John Wiseman, Mechanicsville, VA (US)

(73) Assignee: CONNECTED SOLUTIONS GROUP, LLC, Mechanicsville, VA (US)

( * ) Notice: Subject to any disclaimer, the term of this patent is extended or adjusted under 35 U.S.C. 154(b) by 103 days.

(21) Appl. No.: 16/509,718

(22) Filed: Jul. 12, 2019

(65) Prior Publication Data

US 2021/0009311 A1 Jan. 14, 2021

(51) Int. Cl.
*B65D 25/04* (2006.01)
*B65D 81/05* (2006.01)
*B65D 43/16* (2006.01)

(52) U.S. Cl.
CPC ..... *B65D 25/04* (2013.01); *B65D 43/163* (2013.01); *B65D 81/05* (2013.01)

(58) Field of Classification Search
CPC ..... B65D 25/04
USPC ..... 220/23.83, 23.86, 23.88
See application file for complete search history.

(56) References Cited

U.S. PATENT DOCUMENTS 1,061,374 A * 5/1913 Harrington ..... B65D 25/04 217/8
2,196,024 A * 4/1940 North ..... B65D 25/52 312/266
2,775,498 A * 12/1956 Gettel ..... B25H 3/025 312/201
5,454,478 A * 10/1995 Everson ..... A45C 13/02 220/23.83
6,969,132 B1 * 11/2005 Viville ..... A47B 31/02 211/1.3
7,857,139 B2 * 12/2010 Contes ..... H01L 21/67383 206/710
10,165,703 B1 * 12/2018 Adrian ..... H05K 7/1435
2007/0033858 A1 * 2/2007 Marino ..... A01K 97/22 43/54.1

* cited by examiner

*Primary Examiner* — Stephen J Castellano
(74) *Attorney, Agent, or Firm* — Bernard G. Pike; Pike IP Law

(57) ABSTRACT

An enclosure comprises a bottom container and first and second shelves hingedly connected to the enclosure. The first shelf is movable between a storage position in which its shelf receiving portion is positioned entirely within the bottom container and an in-use position in which its receiving portion at least partially extends beyond a first corresponding wall of the bottom container. The second shelf is movable between a storage position in which its receiving portion is positioned entirely within the bottom container and an in-use position in which its receiving portion at least partially extends beyond a second corresponding wall of the bottom container. When the first and second shelves are in their respective storage positions, the receiving portions of the first and second shelves are positioned in a stacked arrangement such that the second shelf receiving portion is higher than the first shelf receiving portion within the bottom container.

15 Claims, 4 Drawing Sheets

ELECTRONICS ENCLOSURE

FIELD OF THE INVENTION

The present invention relates to enclosures for electronic devices such as communication equipment.

BACKGROUND OF THE DISCLOSURE

Large scale emergencies, such as natural disasters, require the deployment of large numbers of personnel and equipment, often to remote locations. Communications among the various responding resources is often difficult. It is known to use vehicle-based communications centers in which hardware to provide one or more communications technologies at the site of the emergency are mounted in an emergency vehicle. Such communications technologies may include cellular, satellite, microwave, radio frequency (RF), etc. While such vehicle-based communications centers are able to provide necessary communications capability at many remote locations, vehicle-based communications centers may not be able to be driven everywhere such capability may be needed.

It is also known to use man-portable communications centers, in which hardware to provide one or more communications technologies are contained within an enclosure that is small and lightweight enough to be carried by one person. Such man-portable communications centers can be transported almost anywhere. However, their small size, which is necessary for portability, can result in reduced usability and thermal management problems (i.e., overheating) due to the "shoe-horning" of equipment that results when equipping such man-portable communications centers with all of the desired communications equipment.

BRIEF SUMMARY OF THE DISCLOSURE

Embodiments of the invention comprise an enclosure for electronics/communication equipment. In one embodiment of the invention, an enclosure comprises a bottom container, a first shelf hingedly connected to the enclosure, and a second shelf hingedly connected to the enclosure. The bottom container comprises a floor, a left wall, a right wall, a front wall, and a back wall. The floor, the left wall, the right wall, the front wall, and the back wall define an inner volume of the bottom container. The first shelf comprises a receiving portion for selectively receiving and supporting an object. The first shelf is selectively movable between (i) a storage position in which the first shelf receiving portion is positioned entirely within the inner volume of the bottom container and (ii) an in-use position in which the first shelf receiving portion at least partially extends beyond a first corresponding wall of the bottom container. The second shelf comprises a receiving portion for selectively receiving and supporting an object. The second shelf is selectively movable between (i) a storage position in which the second shelf receiving portion is positioned entirely within the inner volume of the bottom container and (ii) an in-use position in which the second shelf receiving portion at least partially extends beyond a second corresponding wall of the bottom container. When the first and second shelves are in their respective storage positions, the receiving portions of the first and second shelves are positioned in a stacked arrangement such that the second shelf receiving portion is higher than the first shelf receiving portion within the inner volume of the bottom container.

The enclosure may further comprise a cushioning material affixed to a bottom surface of the first shelf receiving portion to provide cushioning to an object connected to the second shelf receiving portion when the first and second shelves are in their respective storage positions.

The enclosure may further comprise a third shelf hingedly connected to the enclosure. The third shelf comprises a receiving portion for selectively receiving and supporting an object. The third shelf is selectively movable between (i) a storage position in which the third shelf receiving portion is positioned entirely within the inner volume of the bottom container and (ii) an in-use position in which the third shelf receiving portion at least partially extends beyond a third corresponding wall of the bottom container. When the first, second, and third shelves are in their respective storage positions, the receiving portions of the first, second, and third shelves are positioned in a stacked arrangement such that the second shelf receiving portion and the third shelf receiving portion are higher than the first shelf receiving portion within the inner volume of the bottom container.

The first shelf may be a front shelf, the first shelf receiving portion may be front shelf receiving portion, and the front shelf receiving portion may at least partially extends beyond the front wall of the bottom container when the front shelf is in its in-use position. The second shelf may be a left side shelf, the second shelf receiving portion may be a left side shelf receiving portion, and the left side shelf receiving portion may at least partially extends beyond the left wall of the bottom container when the left side shelf is in its in-use position. The third shelf may be a right side shelf, the third shelf receiving portion may be a right side shelf receiving portion, and the right side shelf receiving portion may at least partially extends beyond the right wall of the bottom container when the right side shelf is in its in-use position.

The enclosure may further comprise an insert positioned within the inner volume of the bottom container. The insert may comprise an insert front wall, an insert back wall, an insert left wall, and an insert right wall. The insert may be connected to the bottom container via the floor and/or one or more of the walls of the bottom container.

The front shelf may be hingedly connected to the enclosure via a hinged connection to either (i) the front wall of the bottom container, (ii) the floor of the bottom container, or (iii) the insert front wall. The left side shelf may be hingedly connected to the enclosure via a hinged connection to either (i) the left wall of the bottom container, (ii) the floor of the bottom container, or (iii) the insert left wall. The right side shelf may be hingedly connected to the enclosure via a hinged connection to either (i) the right wall of the bottom container, (ii) the floor of the bottom container, or (iii) the insert right wall.

The enclosure may further comprise a lid hingedly connected to the back wall of the bottom container.

In alternative embodiments of the invention, an enclosure comprises a bottom container, an insert positioned within the inner volume of the bottom container, a first shelf hingedly connected to a first corresponding insert wall, and a second shelf hingedly connected to a second corresponding insert wall. The bottom container comprises a floor, a left wall, a right wall, a front wall, and a back wall. The floor, the left wall, the right wall, the front wall, and the back wall define an inner volume of the bottom container. The insert comprises an insert front wall, an insert back wall, an insert left wall, and an insert right wall. The insert is connected to the bottom container via the floor and/or one or more of the walls of the bottom container. The first shelf comprises a receiving portion for selectively receiving and supporting an object. The first shelf is selectively movable between (i) a storage position in which the first shelf receiving portion is positioned entirely within the inner volume of the bottom container and (ii) an in-use position in which the first shelf receiving portion at least partially extends beyond a first corresponding wall of the bottom container. The second shelf comprises a receiving portion for selectively receiving and supporting an object. The second shelf is selectively movable between (i) a storage position in which the second shelf receiving portion is positioned entirely within the inner volume of the bottom container and (ii) an in-use position in which the second shelf receiving portion at least partially extends beyond a second corresponding wall of the bottom container. When the first and second shelves are in their respective storage positions, the receiving portions of the first and second shelves are positioned in a stacked arrangement such that the second shelf receiving portion is higher than the first shelf receiving portion within the inner volume of the bottom container.

In other alternative embodiments of the invention, an enclosure comprises a bottom container, an insert positioned within the inner volume of the bottom container, a front shelf hingedly connected to the insert front wall, a left side shelf hingedly connected to the insert left wall, and a right side shelf hingedly connected to the insert right wall. The bottom container comprises a floor, a left wall, a right wall, a front wall, and a back wall. The floor, the left wall, the right wall, the front wall, and the back wall define an inner volume of the bottom container. The insert comprises an insert front wall, an insert back wall, an insert left wall, and an insert right wall. The insert is connected to the bottom container via the floor and/or one or more of the walls of the bottom container. The front shelf comprises a receiving portion for selectively receiving and supporting an object. The front shelf is selectively movable between (i) a storage position in which the front shelf receiving portion is positioned entirely within the inner volume of the bottom container and (ii) an in-use position in which the front shelf receiving portion at least partially extends beyond the front wall of the bottom container. The left side shelf comprises a receiving portion for selectively receiving and supporting an object. The left side shelf is selectively movable between (i) a storage position in which the left side shelf receiving portion is positioned entirely within the inner volume of the bottom container and (ii) an in-use position in which the left side shelf receiving portion at least partially extends beyond the left wall of the bottom container. The right side shelf comprises a receiving portion for selectively receiving and supporting an object. The right side shelf is selectively movable between (i) a storage position in which the right side shelf receiving portion is positioned entirely within the inner volume of the bottom container and (ii) an in-use position in which the right side shelf receiving portion at least partially extends beyond the right wall of the bottom container. When the front, left side, and right side shelves are in their respective storage positions, the receiving portions of the front, left side, and right side shelves are positioned in a stacked arrangement such that the left side shelf receiving portion and the right side shelf receiving portion are higher than the front shelf receiving portion within the inner volume of the bottom container.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
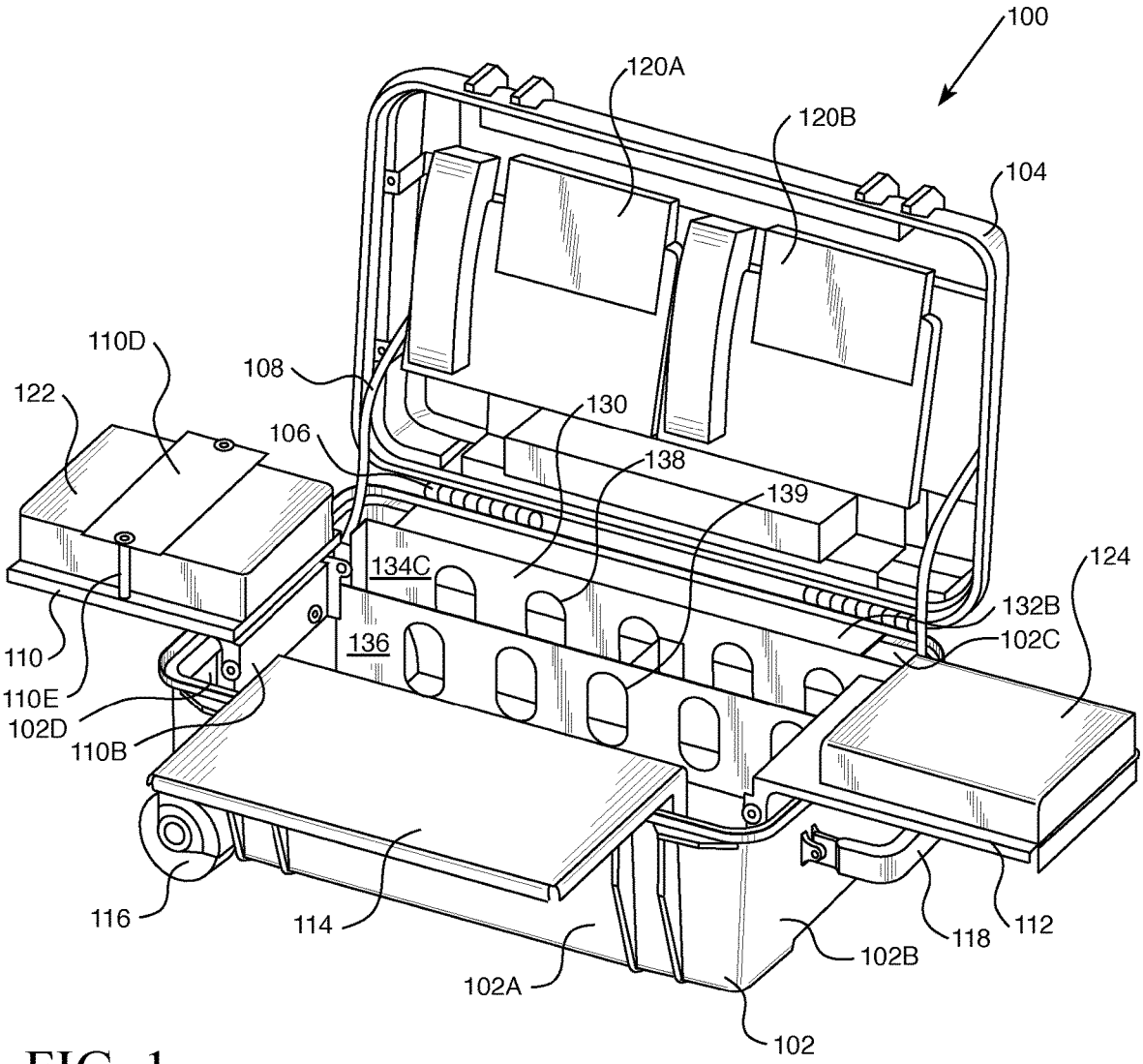
FIG. 1 is a perspective view of a communications enclosure, in an open position with unfolded shelves, in accordance with embodiments of the present invention.
Figure 2:
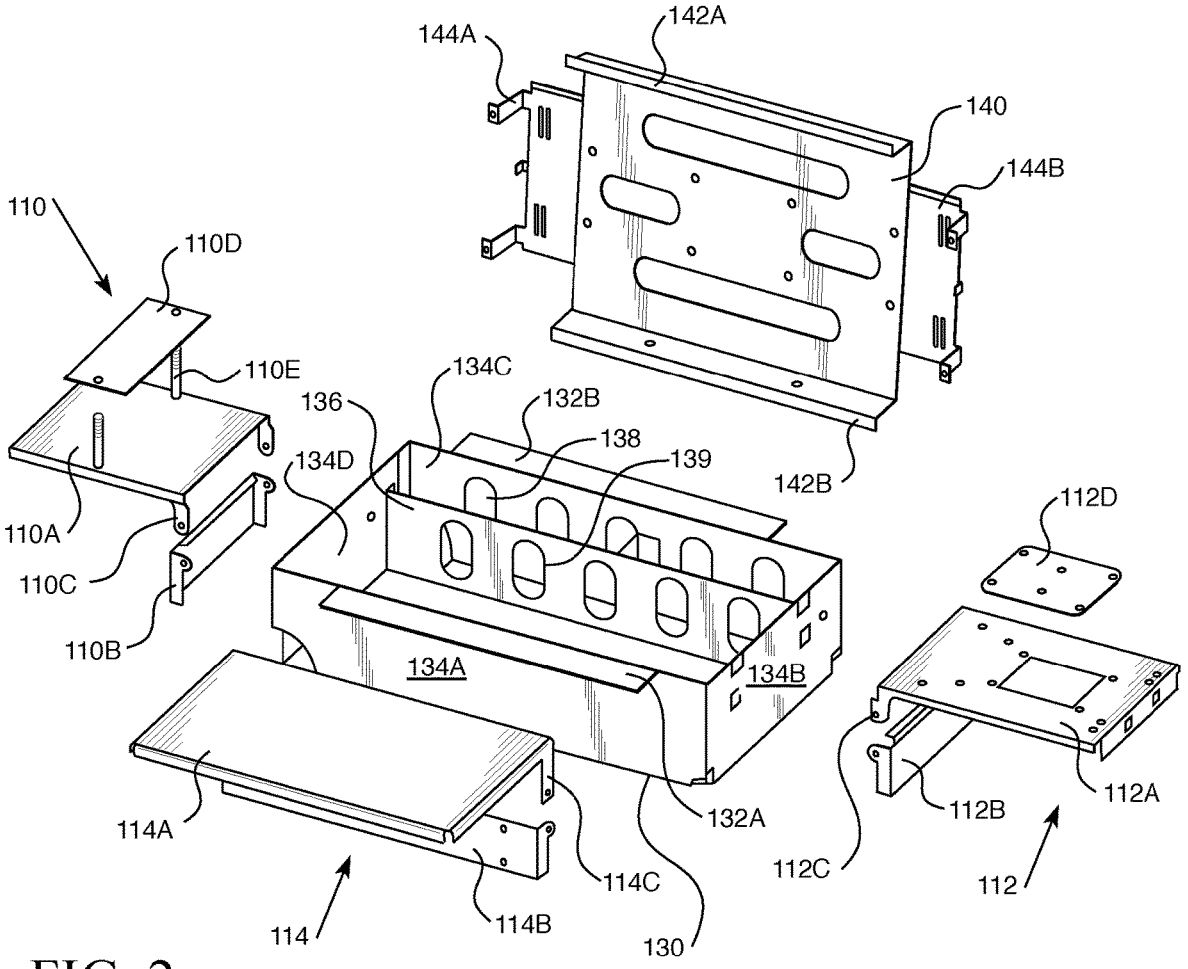
FIG. 2 is a perspective view of an insert removed from the communications enclosure of FIG. 1.
Figure 3:
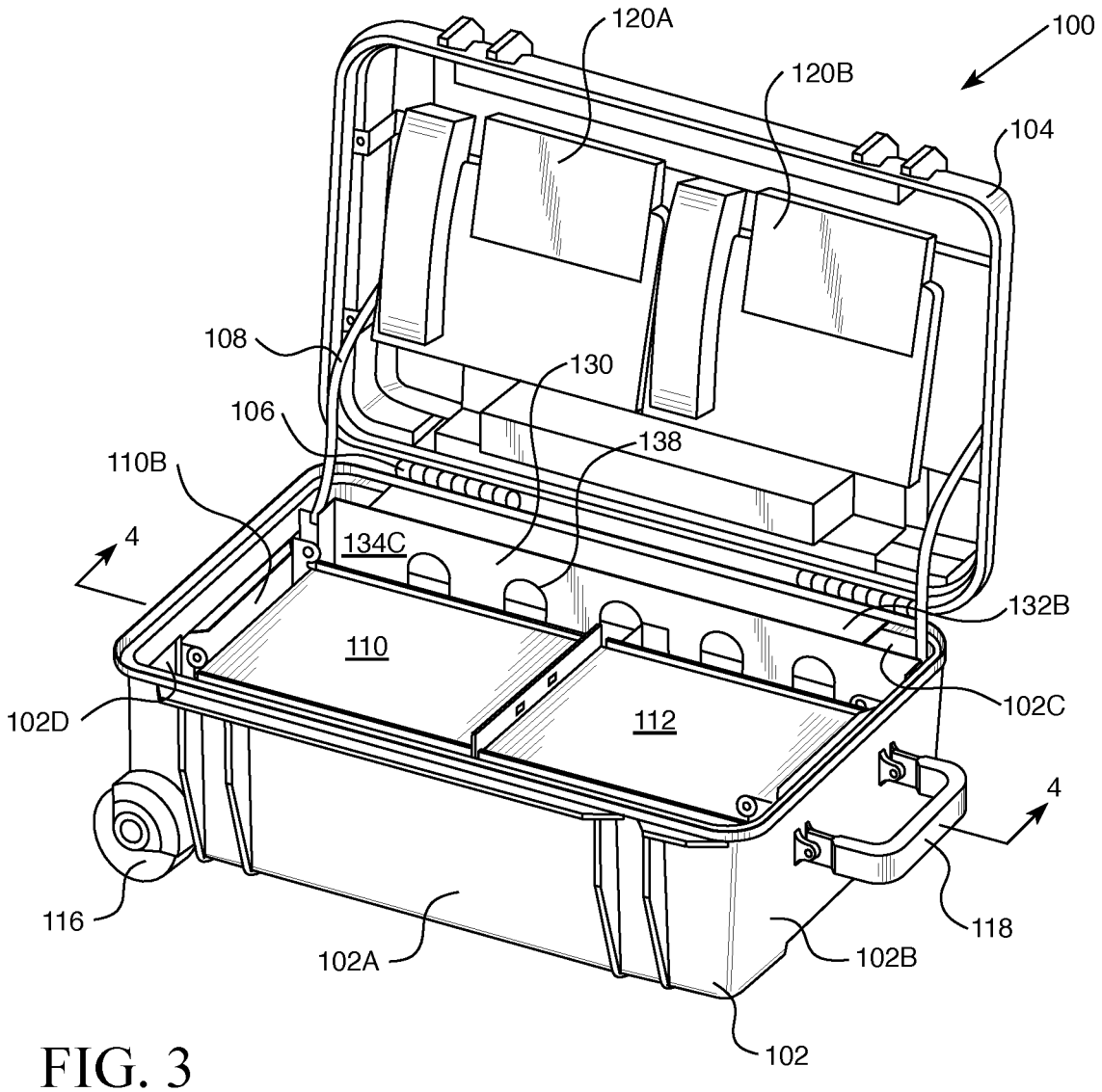
FIG. 3 is a perspective view of the communications enclosure of FIG. 1, in an open position with folded shelves.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention are directed to an enclosure for storing, transporting, and operating hardware to provide one or more communications technologies (and/or other electronic equipment) in a form that enables improved usability and thermal management as compared to conventional enclosures.

Referring now to FIGS. 1-4, an enclosure 100 comprises a bottom container 102 and a lid 104 hingedly connected thereto. The bottom container 102 comprises a floor 102E, a left wall 102D, a right wall 102B, a front wall 102A, and a back wall 102C, which together define an inner volume of the bottom container 102. The lid 104 is movable between a closed position (not illustrated) closing off the inner volume of the bottom container 102 and an open position enabling access to the inner volume of the bottom container 102. The lid 104 is hingedly connected to the back wall 102C of the bottom container 102 via conventional hinges 106. One or two conventional lid supports 108 may be attached to the bottom container 102 and the lid 104 to keep the lid 104 in the open position when desired. One or more (typically two) wheels 116 on one end of the enclosure 100 and a handle 118 on the opposite end of the enclosure 100 enable easier transport of the enclosure 100 over even surfaces. The bottom container 102 and lid 104 may be constructed of any suitable material that is sufficiently strong, durable, and rigid, such as any suitable plastic or metal.

In alternative embodiments of the invention (not illustrated), the hinged lid may be selectively separable from the bottom container. In other alternative embodiments of the invention (not illustrated), the lid may be connected to the bottom container only when the lid is closed (such as via snaps, clips, or any suitable attachment mechanism) and the lid is separated from the bottom container for use. In such alternative embodiments, the separated lid may be attached to and supported by a stand.

Because the bottom container 102 may be constructed of plastic, an insert 130 may be positioned within the inner volume of the bottom container 102. The insert 130 provides surfaces that are more rigid than the surfaces of a plastic bottom container 102 to which one or more shelves (described below) may be mounted. The insert 130 comprises an insert front wall 134A, an insert back wall 134C, an insert left wall 134D, and an insert right wall 134B. The insert 130 may also comprise a dividing wall 136 to provide a segregated space (between insert back wall 134C and insert dividing wall 136) for cabling, etc. A plurality of holes 139 may be defined in the insert dividing wall 136 and/or a plurality of holes 138 may be defined in the insert back wall 134C to enable wires/cabling (e.g., power, communications, etc.) to be run among the various electronic components in the enclosure 100. The insert 130 may be constructed of any suitable material that is sufficiently strong, durable, and rigid, but typically any suitable metal.

The insert 130 may be connected to the bottom container 102 in any suitable manner, such as being attached to the floor 102E and/or one or more of the walls 102A-D of the bottom container 102. In the illustrated embodiment, the insert 130 has a front mounting flange 132A extending substantially horizontally from the top edge of the insert front wall 134A and a back mounting flange 132B extending substantially horizontally from the top edge of the insert back wall 134C. The front mounting flange 132A is secured to the front wall 102A of the bottom container 102 (using any suitable mounting hardware) and the back mounting flange 132B is secured to the back wall 102C of the bottom container 102 (using any suitable mounting hardware). The mounting hardware (screws, nuts, bolts, etc.) is omitted from the figures for simplicity.

One or more shelves may be mounted to the insert 130, or to the bottom container 102 (walls and/or floor) if the enclosure does not have an insert. In the illustrated embodiment, there are three shelves. A front shelf 114 is hingedly connected to the insert front wall 134A; a left side shelf 110 is hingedly connected to the insert left wall 134D; and a right side shelf 112 is hingedly connected to the insert right wall 134B. The front shelf 114 comprises a receiving portion 114A for selectively receiving and supporting an object. The receiving portion 114A is generally planar. The front shelf 114 is connected to the insert 130 via mounting bracket 114B (or any other suitable mechanism). The front shelf 114 is selectively movable between (i) a storage position in which the front shelf receiving portion 114A is positioned entirely within the inner volume of the bottom container 102 (FIGS. 3 and 4) and (ii) an in-use position in which the front shelf receiving portion 114A at least partially extends beyond the front wall 102A of the bottom container 102 (FIG. 1). The elbows 114C that extend downward from two corners of the receiving portion 114A and which connect the receiving portion 114A to the mounting bracket 114B enable the described movement between the storage and in-use positions.

The left side shelf 110 comprises a receiving portion 110A for selectively receiving and supporting an object. The receiving portion 110A is generally planar. The left side shelf 110 is connected to the insert 130 via mounting bracket 110B (or any other suitable mechanism). The left side shelf 110 is selectively movable between (i) a storage position in which the left side shelf receiving portion 110A is positioned entirely within the inner volume of the bottom container 102 (FIGS. 3 and 4) and (ii) an in-use position in which the left side shelf receiving portion 110A at least partially extends beyond the left wall 102D of the bottom container 102 (FIG. 1). The elbows 110C that extend downward from two corners of the receiving portion 110A and which connect the receiving portion 110A to the mounting bracket 110B enable the described movement between the storage and in-use positions.

The right side shelf 112 comprises a receiving portion 112A for selectively receiving and supporting an object. The receiving portion 112A is generally planar. The right side shelf 112 is connected to the insert 130 via mounting bracket 112B (or any other suitable mechanism). The right side shelf 112 is selectively movable between (i) a storage position in which the right side shelf receiving portion 112A is positioned entirely within the inner volume of the bottom container 102 (FIGS. 3 and 4) and (ii) an in-use position in which the right side shelf receiving portion 112A at least partially extends beyond the right wall 102B of the bottom container 102 (FIG. 1). The elbows 112C that extend downward from two corners of the receiving portion 112A and which connect the receiving portion 112A to the mounting bracket 112B enable the described movement between the storage and in-use positions.

Figure 4:
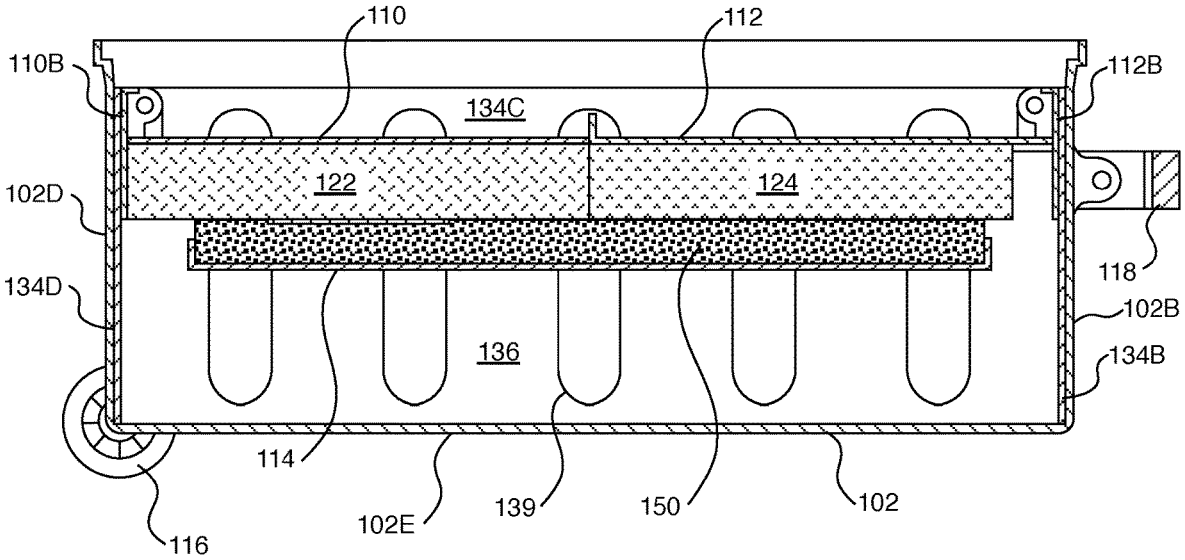
FIG. 4 is a sectional view along line 4-4 of the communications enclosure of FIG. 1.

In the illustrated embodiment, the front shelf 114 is designed to support an object (e.g., a laptop computer) only when the front shelf 114 is in its in-use position. The object would be removed from the front shelf 114 when the front shelf 114 is moved to its storage position. In contrast, the left side shelf 110 and the right side shelf 112 are designed such that an object may be attached to one or both side shelves and stay attached whether the side shelves are in their respective storage positions or in their respective in-use positions. Various mechanisms may be used to attach objects to the side shelves. In the illustrated embodiment, an object may be attached to the left side shelf 110 via a clamping plate 110D that is secured to the receiving portion 110A via posts 110E. FIGS. 1 and 4 show a generic device 122 (e.g., a battery) attached to left side shelf 110. The right side shelf 112 uses a different mechanism to attach an object. The right side shelf 112 has a number of holes in the receiving portion 112A to enable an object to be screwed or bolted onto the right side shelf 112. The receiving portion 112A has a large opening that may be occluded as needed by adapter plate 112D depending on the structure of the attached object. FIGS. 1 and 4 show a generic device 124 (e.g., a communications transceiver) attached to right side shelf 112.

Advantageously, when the front shelf 114, the left side shelf 110, and the right side shelf 112 are in their respective storage positions, the receiving portions 114A, 110A, 112A shelves are positioned in a stacked arrangement such that the left side shelf receiving portion 110A and the right side shelf receiving portion 112A are higher than the front shelf receiving portion 114A within the inner volume of the bottom container. The left side shelf receiving portion 110A and the right side shelf receiving portion 112A are side-by-side at the same (or approximately the same) level in the inner volume when in their storage positions. In this regard, device 122 attached to the left side shelf receiving portion 110A and device 124 attached to the right side shelf receiving portion 112A are securely stored within the enclosure. A cushioning material 150 (e.g., any suitable foam or pad) may be affixed to the bottom surface of the front shelf receiving portion 114A. This cushioning material 150 provides cushioning to help protect devices 122, 124 when the shelves 114, 110, 112 are in their respective storage positions. This stacked arrangement is shown in FIG. 4.

In alternative embodiments of the invention (not illustrated), the front shelf may be omitted such that there is no stacking of the shelves in the storage positions. In other alternative embodiments of the invention (not illustrated), the left and right shelves may be at different heights in the inner volume such that the left shelf is higher than the right shelf or vice versa when in their storage positions (in this alternative embodiment, the left and right shelves could be wider as they would not need to fit side-by-side in the inner volume.

A lid bracket 140 may be secured to the inner surface of the lid 104 to enable equipment to be securely mounted to the lid 104. In the illustrated embodiment, the lid bracket 140 is generally planar with top and bottom mounting flanges 142A, 142B and left and right mounting flanges 144A, 144B for securing the lid bracket 140 to the perimeter of the lid 104 (using any suitable mounting hardware (not illustrated)). The lid bracket 140 may be constructed of any suitable material that is sufficiently strong, durable, and rigid, but typically any suitable metal. Any suitable type and quantity of equipment may be mounted to the lid 104 via the lid mounting bracket 140, such as telephones, radios, computer screens, etc. In the illustrated embodiment, two telephones 120A, 120B are mounted to the lid 104 via the lid mounting bracket 140.

In alternative embodiments of the invention (not illustrated), the insert may be omitted in which case the shelves would be attached directly to the walls and/or floor of the bottom container. Similarly, the lid insert may be omitted in which case equipment would be attached directly to the lid.

When the shelves 110, 112, 114 are all in their closed positions and the lid 104 is closed, the equipment attached to the side shelves 112, 114 and to the lid 104 is securely retained and protected within the enclosure 100. When the lid 104 is opened and the shelves 110, 112, 114 are moved to their in-use positions, all of the equipment is easily accessible for use. Advantageously, by raising the equipment on the side shelves 112, 114 out of the inner volume of the bottom container 102, airflow around the equipment is improved and the likelihood of the equipment overheating is greatly reduced. The front shelf 114 acts as a counterweight (whether in its storage or in-use position) to the lid 104, lid mounting bracket 140, and equipment (such as telephones 120A, 120B) mounted to the lid to help prevent the enclosure 100 from tipping over when the lid 104 is open.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. An enclosure comprising:

a bottom container comprising a floor, a left wall, a right wall, a front wall, and a back wall, wherein the floor, the left wall, the right wall, the front wall, and the back wall define an inner volume of the bottom container, wherein the left wall, the right wall, and the front wall are the same height above the floor;

a first shelf hingedly connected to the enclosure, wherein the first shelf comprises a receiving portion for selectively receiving and supporting an object, wherein the first shelf is selectively movable between (i) a storage position in which the first shelf receiving portion is positioned entirely within the inner volume of the bottom container and (ii) an in-use position in which the first shelf receiving portion at least partially extends beyond a first corresponding wall of the bottom container; and a second shelf hingedly connected to the enclosure, wherein the second shelf comprises a receiving portion for selectively receiving and supporting an object, wherein the second shelf is selectively movable between (i) a storage position in which the second shelf receiving portion is positioned entirely within the inner volume of the bottom container and (ii) an in-use position in which the second shelf receiving portion at least partially extends beyond a second corresponding wall of the bottom container;

wherein, when the first and second shelves are in their respective storage positions, the receiving portions of the first and second shelves are positioned in a stacked arrangement such that the second shelf receiving portion is higher than the first shelf receiving portion within the inner volume of the bottom container, wherein each receiving portion comprises an elbow that extends downward from two corners of the receiving portion enabling the motion from the storage to in-use positions.

2. The enclosure of claim 1, further comprising a cushioning material affixed to a bottom surface of the first shelf receiving portion to provide cushioning to an object connected to the second shelf receiving portion when the first and second shelves are in their respective storage positions.

3. The enclosure of claim 1, further comprising:

a third shelf hingedly connected to the enclosure, wherein the third shelf comprises a receiving portion for selectively receiving and supporting an object, wherein the third shelf is selectively movable between (i) a storage position in which the third shelf receiving portion is positioned entirely within the inner volume of the bottom container and (ii) an in-use position in which the third shelf receiving portion at least partially extends beyond a third corresponding wall of the bottom container;

wherein, when the first, second, and third shelves are in their respective storage positions, the receiving portions of the first, second, and third shelves are positioned in a stacked arrangement such that the second shelf receiving portion and the third shelf receiving portion are higher than the first shelf receiving portion within the inner volume of the bottom container.

4. The enclosure of claim 3, wherein the first shelf is a front shelf, the first shelf receiving portion is a front shelf receiving portion, and the front shelf receiving portion at least partially extends beyond the front wall of the bottom container when the front shelf is in its in-use position;

wherein the second shelf is a left side shelf, the second shelf receiving portion is a left side shelf receiving portion, and the left side shelf receiving portion at least partially extends beyond the left wall of the bottom container when the left side shelf is in its in-use position; and wherein the third shelf is a right side shelf, the third shelf receiving portion is a right side shelf receiving portion, and the right side shelf receiving portion at least partially extends beyond the right wall of the bottom container when the right side shelf is in its in-use position.

5. The enclosure of claim 3, wherein the second shelf receiving portion and the third shelf receiving portion are side-by-side at the same level in the inner volume when in their storage positions.

6. The enclosure of claim 4, further comprising an insert positioned within the inner volume of the bottom container, wherein the insert comprises an insert front wall, an insert back wall, an insert left wall, and an insert right wall, and wherein the insert is connected to the bottom container via the floor and/or one or more of the walls of the bottom container.

7. The enclosure of claim 6, wherein the front shelf is hingedly connected to the enclosure via a hinged connection to either (i) the front wall of the bottom container, (ii) the floor of the bottom container, or (iii) the insert front wall;

wherein the left side shelf is hingedly connected to the enclosure via a hinged connection to either (i) the left wall of the bottom container, (ii) the floor of the bottom container, or (iii) the insert left wall;

and wherein the right side shelf is hingedly connected to the enclosure via a hinged connection to either (i) the right wall of the bottom container, (ii) the floor of the bottom container, or (iii) the insert right wall.

8. The enclosure of claim 6, comprises a plurality of holes defined in the insert back wall to enable wires/cabling to be run among various electronic components in the enclosure.

9. The enclosure of claim 1, further comprising:

a lid hingedly connected to the back wall of the bottom container.

10. An enclosure comprising:

a bottom container comprising a floor, a left wall, a right wall, a front wall, and a back wall, wherein the floor, the left wall, the right wall, the front wall, and the back wall define an inner volume of the bottom container, wherein the left wall, the right wall, and the front wall are the same height above the floor;

a lid hingedly connected to the back wall of the bottom container;

an insert positioned within the inner volume of the bottom container, wherein the insert comprises an insert front wall, an insert back wall, an insert left wall, and an insert right wall, and wherein the insert is connected to the bottom container via the floor and/or one or more of the walls of the bottom container;

a first shelf hingedly connected to a first corresponding insert wall, wherein the first shelf comprises a receiving portion for selectively receiving and supporting an object, wherein the first shelf is selectively movable between (i) a storage position in which the first shelf receiving portion is positioned entirely within the inner volume of the bottom container and (ii) an in-use position in which the first shelf receiving portion at least partially extends beyond a first corresponding wall of the bottom container; and a second shelf hingedly connected to a second corresponding insert wall, wherein the second shelf comprises a receiving portion for selectively receiving and supporting communication transceiver, wherein the second shelf is selectively movable between (i) a storage position in which the second shelf receiving portion is positioned entirely within the inner volume of the bottom container and (ii) an in-use position in which the second shelf receiving portion at least partially extends beyond a second corresponding wall of the bottom container;

wherein, when the first and second shelves are in their respective storage positions, the receiving portions of the first and second shelves are positioned in a stacked arrangement such that the second shelf receiving portion is higher than the first shelf receiving portion within the inner volume of the bottom container.

11. The enclosure of claim 10, further comprising a cushioning material affixed to a bottom surface of the first shelf receiving portion to provide cushioning to the transmission transceiver connected to the second shelf receiving portion when the first and second shelves are in their respective storage positions.

12. The enclosure of claim 10, further comprising:

a third shelf hingedly connected to a third corresponding insert wall, wherein the third shelf comprises a receiving portion for selectively receiving and supporting a a battery, wherein the third shelf is selectively movable between (i) a storage position in which the third shelf receiving portion is positioned entirely within the inner volume of the bottom container and (ii) an in-use position in which the third shelf receiving portion at least partially extends beyond a third corresponding wall of the bottom container;

wherein, when the first, second, and third shelves are in their respective storage positions, the receiving portions of the first, second, and third shelves are positioned in a stacked arrangement such that the second shelf receiving portion and the third shelf receiving portion are side-by-side at the same level in the inner volume in their storage positions and are higher than the first shelf receiving portion within the inner volume of the bottom container and both the battery and the transmission receiver are in contact with a cushioning material affixed to the bottom surface of the receiving portion of the first shelf.

13. The enclosure of claim 12, wherein the first shelf is a front shelf, the first shelf receiving portion is a front shelf receiving portion, and the front shelf receiving portion at least partially extends beyond the front wall of the bottom container when the front shelf is in its in-use position;

wherein the second shelf is a left side shelf, the second shelf receiving portion is a left side shelf receiving portion, and the left side shelf receiving portion at least partially extends beyond the left wall of the bottom container when the left side shelf is in its in-use position; and wherein the third shelf is a right side shelf, the third shelf receiving portion is a right side shelf receiving portion and the right side shelf receiving portion at least partially extends beyond the right wall of the bottom container when the right side shelf is in its in-use position.

14. An enclosure comprising:

a bottom container comprising a floor, a left wall, a right wall, a front wall, and a back wall wherein the floor, the left wall, the right wall, the front wall, and the back wall define an inner volume of the bottom container, wherein the left wall, the right wall, and the front wall are the same height above the floor;

a lid hingedly connected to the back wall of the bottom container;

an insert positioned within the inner volume of the bottom container, wherein the insert comprises an insert front wall, an insert back wall, an insert left wall, and an insert right wall, and wherein the insert is connected to the bottom container via the floor and/or one or more of the walls of the bottom container;

a front shelf hingedly connected to the insert front wall, wherein the front shelf comprises a receiving portion for selectively receiving and supporting an object, wherein the front shelf is selectively movable between (i) a storage position in which the front shelf receiving portion is positioned entirely within the inner volume of the bottom container and (ii) an in-use position in which the front shelf receiving portion at least partially extends beyond the front wall of the bottom container;

a left side shelf hingedly connected to the insert left wall, wherein the left side shelf comprises a receiving portion for selectively receiving and supporting a first object, wherein the left side shelf is selectively movable between (i) a storage position in which the left side shelf receiving portion is positioned entirely within the inner volume of the bottom container and (ii) an in-use position in which the left side shelf receiving portion at least partially extends beyond the left wall of the bottom container; and a right side shelf hingedly connected to the insert right wall, wherein the right side shelf comprises a receiving portion for selectively receiving and supporting a second object, wherein the right side shelf is selectively movable between (i) a storage position in which the right side shelf receiving portion is positioned entirely within the inner volume of the bottom container and (ii) an in-use position in which the right side shelf receiving portion at least partially extends beyond the right wall of the bottom container;

wherein, when the front, left side, and right side shelves are in their respective storage positions, the receiving portions of the front, left side, and right side shelves are positioned in a stacked arrangement such that the left side shelf receiving portion and the right side shelf receiving portion are side-by-side at the same level in the inner volume in their storage positions and are higher than the front shelf receiving portion within the inner volume of the bottom container and both the first object and the second object are in contact with a cushioning material affixed to the bottom surface of the receiving portion of the first shelf.

15. The enclosure of claim 14, further comprising a cushioning material affixed to a bottom surface of the front shelf receiving portion to provide cushioning to an object connected to the left side shelf receiving portion and/or an object connected to the right side shelf receiving portion when the front, left side, and right side shelves are in their respective storage positions.

* * * * *